United States Patent [19]

Blake

[11] Patent Number: 4,741,129

[45] Date of Patent: May 3, 1988

[54] METHOD AND APPARATUS FOR HONING TRUCK RING GEAR BEARING SURFACES

[76] Inventor: Robert Blake, 1444 S. 8th St., Phoenix, Ariz. 85034

[21] Appl. No.: 34,031

[22] Filed: Apr. 1, 1987

[51] Int. Cl.[4] ..... B24B 5/01

[52] U.S. Cl. ..... 51/290; 51/326

[58] Field of Search ..... 51/290, 281 R, 281 P, 51/327, 326, 241 VS, 34 H, 34 R

[56] References Cited

U.S. PATENT DOCUMENTS

| | | | |
|---|---|---|---|
| 1,682,456 | 8/1928 | Yerk et al. | 51/290 |
| 2,666,307 | 1/1954 | Higert | 51/241 VS |
| 2,804,957 | 9/1957 | Pechin, Jr. | 51/241 VS |
| 3,087,281 | 4/1963 | Greening et al. | 51/290 |

*Primary Examiner*—Frederick R. Schmidt
*Assistant Examiner*—Robert A. Rose
*Attorney, Agent, or Firm*—Nissle & Leeds

[57] ABSTRACT

Apparatus for honing at least one of a spaced apart, coaxial pair of cylindrical inner surfaces. The apparatus includes a rotating shaft having a selected length; a pair of expansible and contractible honing tools spaced a selected distance apart and carried on the shaft, at least one of the tools comprising an abrasive stone; means for rotating the shaft; means for adjusting the distance between the honing tools; means for reciprocating the shaft to repeatedly transverse the honing tools over the coaxial cylindrical inner surfaces; and means for independently expandibly and contractibly adjusting each one of the honing tools independently of the other of the honing tools.

1 Claim, 2 Drawing Sheets

FIG. 1.
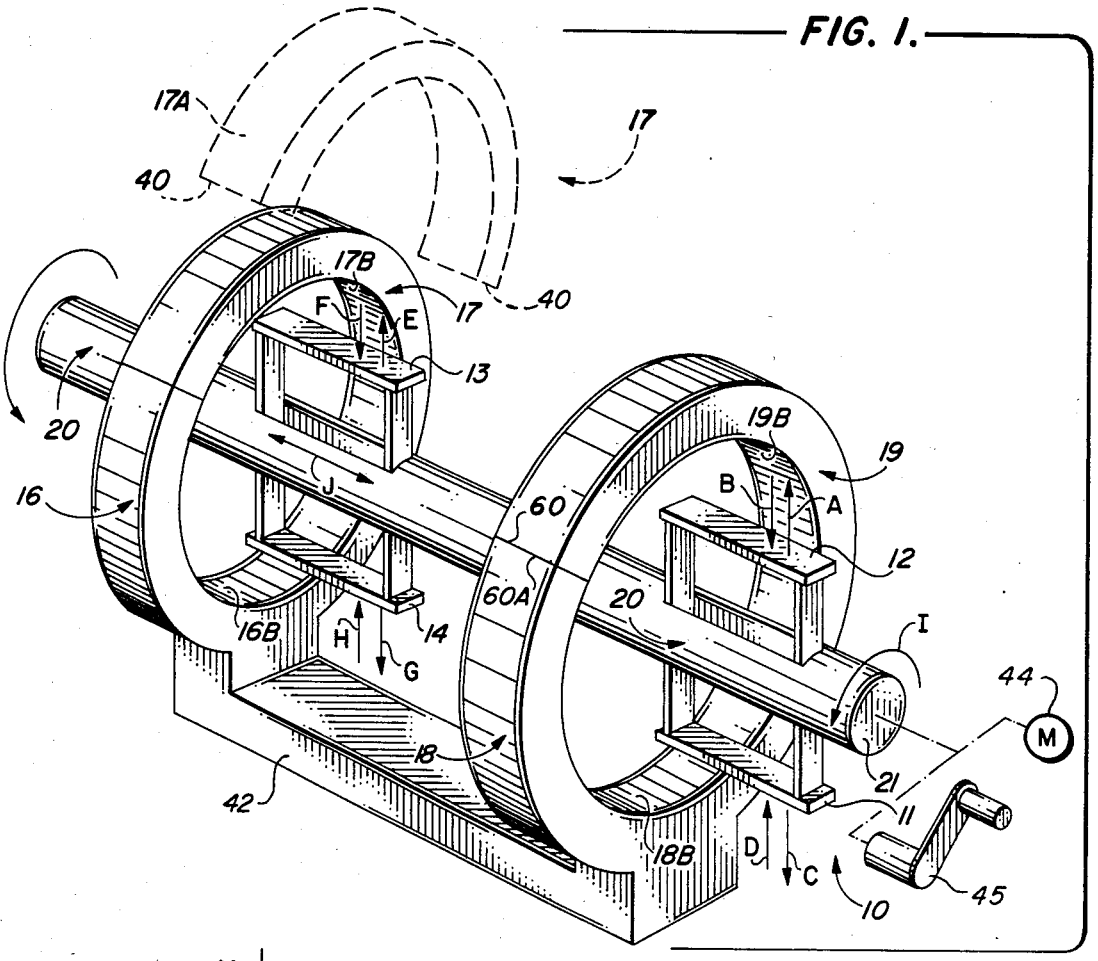
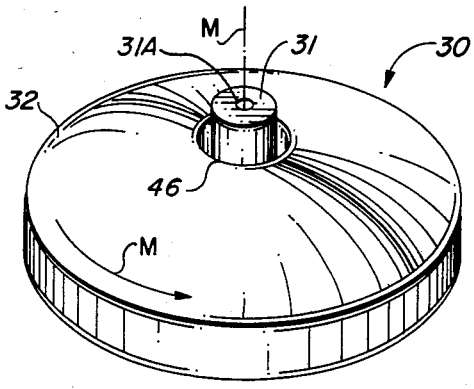
FIG. 2.
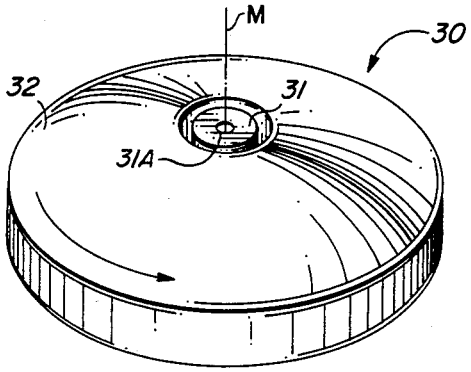
FIG. 3.
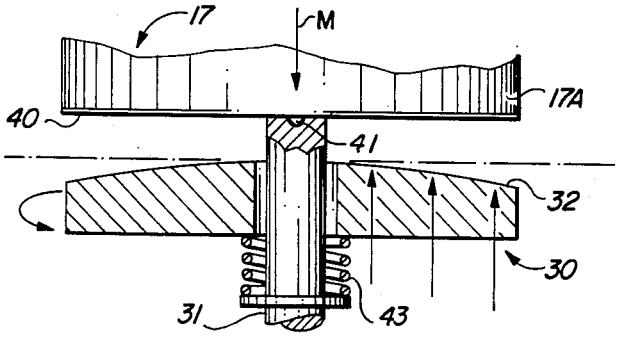
FIG. 4.

METHOD AND APPARATUS FOR HONING TRUCK RING GEAR BEARING SURFACES

This invention relates to honing apparatus.

More particularly, the invention relates to honing apparatus which permits the simultaneous honing of a pair of coaxial spaced apart cylindrical surfaces, the coaxial surfaces each circumscribing a common centerline axis and each having a diameter different than the diameter of the other.

In a further respect, the invention relates to honing apparatus of the type described which can be readily adapted to simultaneously hone a pairs of coaxial cylindrical surfaces, each pair of coaxial cylindrical surfaces being spaced apart a distance which is different than the distance the other coaxial cylindrical surface pairs are spaced apart.

In another respect, the invention pertains to a method and apparatus for truing the coaxial cylindrical inner surface of each of the differential bearing cap assemblies in a truck axle drive unit, the cylindrical inner surfaces of the bearing cap assemblies normally each carrying a circular, hollow cup which receives a differential bearing.

Apparatus for honing the inner cylindrical surface or bore of a piston housing or of another piece of material is well known in the art. See, for example, U.S. Pat. Nos. 2,403,546 to Olsen, 2,599,025 to Stampen, 2,320,747 to Peterson et al., 2,315,794 to Johnson, and 4,497,138 to Schreiber. During the honing process, the inner cylindrical surface being polished is often maintained in a stationary position while a set of spaced apart honing stones in a generally cylindrical holder are rotated over the surface and are simultaneously reciprocated axially in directions along and parallel the centerline of the surface. The length of each honing stone is preferably approximately twice that of the cylindrical surface being polished. As portions of the cylindrical surface are ground away by the honing stones, and, consequently, as the honing stones wear, it is necessary to outwardly radially displace the stones against the cylindrical surface to continue the honing process. The ability of conventional cylindrical honing stone holders to gradually outwardly radially displace the honing stones generally makes the honing process amenable to the polishing of a plurality of equal diameter cylindrical surfaces spaced apart along a common centerline. When a plurality of such equal diameter coaxial surfaces are being polished, a plurality of honing stones rotating about a common shaft can be simultaneously outwardly displaced equal distances in order to polish each of the cylindrical surfaces to an equal diameter. There are, however, disadvantages in such conventional honing apparatus. When a plurality of equal diameter spaced apart colinear cylindrical surfaces are each polished by one of a set of simultaneously controlled honing stone sets on a rotating drive shaft, then the distance of the base of any single honing stone from the center longitudinal axis of the shaft is the same. However, since the surface of one honing stone may wear at a greater rate than that of another honing stone, the distances of the surfaces of each stone from the center of the rotating shaft may vary, which can, unless the stones are continually checked and trued, result in certain of the cylindrical surfaces being polished to diameters different than the surfaces of the remaining cylindrical surfaces. Further, such conventional honing apparatus cannot, since each associated cylindrical set of honing stones is simultaneously adjusted outwardly in increments equal to the outward adjustment of the remaining stones, be used to simultaneously accurately polish a pair of coaxial cylindrical surfaces of differing diameter. Finally, since the distance of each cylindrical group of honing stones from another cylindrical set of honing stones on the rotating drive shaft is fixed, the honing apparatus can only be utilized to polish cylindrical surfaces which are spaced a selected distance apart from each other.

Accordingly, it would be highly desirable to provide improved honing apparatus which would permit a pair of coaxial cylindrical surfaces of differing diameter to be simultaneously honed by spaced apart cylindrically oriented sets of honing stones, and which could be readily utilized on pairs of coaxial cylindrical surfaces which are spaced differing distances apart.

Therefore, it is a principal object of the invention to provide improved apparatus for honing a cylindrical surface.

Another object of the invention is to provide improved honing apparatus which permits coaxial cylindrical surfaces of differing diameter to be simultaneously honed using two separate sets of honing stones each carried on a single rotating drive shaft.

A further object of the instant invention is to provide improved apparatus which can be readily adapted to simultaneously hone pairs of coaxial cylindrical surfaces, each pair of surfaces being spaced apart a distance different than the distance between the other pairs of cylindrical surfaces.

Still another object of the invention is to provide improved honing apparatus which includes a plurality of honing stone sets, each set being carried on a common drive shaft, being spaced apart from the other sets, and being radially adjustable independently from the other sets of honing stones.

Yet another object of the invention is to provide an improved method and apparatus for truing the coaxial cylindrical inner surface of each of the differential bearing cap assemblies in a truck axle drive unit, the cylindrical inner surfaces of the bearing cap assemblies normally carrying a hollow circular cup which receives a differential bearing.

These and other, further and more specific objects and advantages of the invention will be apparent to those skilled in the art from the following detailed description thereof, taken in conjunction with the drawings, in which:

FIG. 1 is a perspective view illustrating honing apparatus constructed in accordance with the principles of the invention and being used to abrade and polish at least one of a pair of coaxial inner cylindrical surfaces of differing diameter;

FIG. 2 is a perspective view illustrating a rotating convex abrading surface utilized to grind and true the planar end surface of the upper portion of each of the differential bearing cap assembly of FIG. 1;

FIG. 3 is a perspective view of the abrading surface of FIG. 2 illustrating the mode of operation thereof;

FIG. 4 is a side section view of the abrading surface of FIG. 2 further illustrating the mode of operation thereof;

Figure 5:
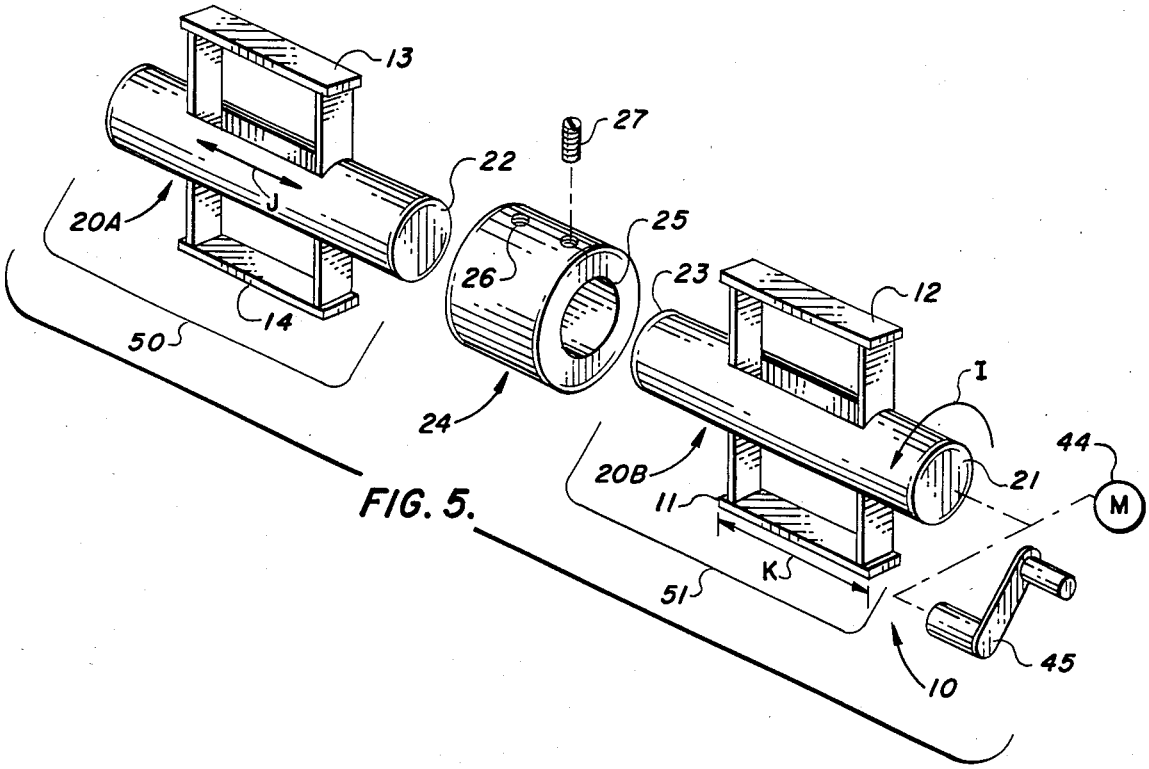
FIG. 5 is a perspective view illustrating an alternate embodiment of honing apparatus constructed in accordance with the principles of the invention.

Briefly, in accordance with my invention, I provide an improved method for truing the coaxial cylindrical inner surfaces of the differential bearing cap assemblies in a truck axle drive unit. The cylindrical inner surfaces normally each carry a cup which receives a differential bearing. The differential bearing cap assemblies are attached to a base and each include a lower generally semicircular portion attached to the base and including a portion of the coaxial cylindrical inner surface of the assembly, the lower portion having a pair of planar surfaces each with an aperture formed therein; and, an upper generally semicircular portion including a portion of the coaxial cylindrical inner surface of the assembly. The upper portion has a pair of planar surfaces opposed to and normally contacting the planar surfaces of the lower portion; and, a pair of guide means each outwardly extending from one of the planar surfaces of the upper member and received by one of the apertures in the planar surfaces of the lower portion. The method comprises the steps of removing the cup and differential bearing from the coaxial inner surface of each of the differential bearing cap assemblies; removing each of the upper generally semicircular portions from the differential bearing cap assemblies; abrading and truing each planar surface of at least one of the upper portions on grinding apparatus; attaching each of the upper generally semicircular portions to one of the lower portions; and, honing at least one of the coaxial cylindrical inner surfaces with abrading apparatus. The grinding apparatus includes a generally convex rotating abrading surface with an opening formed through the center thereof; and, a depressible member extending through said opening and having an aperture sized to slidably receive the guide means. Each of the planar surfaces of the upper portion is abraded and trued by placing the guide means of each planar surface in the aperture of the abrading means and pressing the planar surface against the rotating convex surface. The abrading apparatus includes a rotating shaft; at least a pair of expansible and contractible honing tools spaced apart and carried on the shaft, at least one of the tools comprising an abrasive stone; means for rotating the shaft; means for reciprocating the shaft to repeatedly transverse the honing tools over the coaxial cylindrical inner surfaces; and, means for independently expandably and contractibly adjusting each one of the honing tools independently of the other of the honing tools. The honing of the cylindrical inner surface includes the steps of placing the shaft and honing tools inside the cylindrical inner surfaces; operating the adjustment means to expand each of the honing tools against one of the cylindrical inner surfaces; and, operating the reciprocating means and rotating means to rotatably reciprocate the honing tools over the cylindrical inner surfaces.

In another embodiment of the invention, I provide apparatus for honing at least one of a spaced apart, coaxial pair of cylindrical inner surfaces. The apparatus includes a rotating shaft having a selected length; a pair of expansible and contractible honing tools spaced a selected distance apart and carried on said shaft, at least one of said tools comprising an abrasive stone; means for rotating said shaft; means for adjusting said distance between said honing tools; means for reciprocating said shaft to repeatedly transverse said honing tools over said coaxial cylindrical inner surface; and, means for independently expandably and contractibly adjusting each one of said honing tools independently of the other of said honing tools.

Turning now to the drawings, which depict the presently preferred embodiment and best mode of the invention for the purpose of illustrating the practice thereof and not by way of limitation of the scope of the invention, and in which identical reference characters correspond to like elements throughout the several views, FIGS. 1-6 illustrate the method and apparatus of the invention. A simplified representation of the differential bearing cap assemblies in a truck drive axle unit is shown in FIG. 1. One differential bearing cap assembly includes a lower portion 16 and an upper portion 17. The other bearing cap assembly includes bottom portion 18 and upper portion 19. Bolts (not shown) secure top portion 17 to lower portion 16 and also secure top portion 19 to lower portion 18. Inner semicircular surface 17B and surface 16B together form an inner cylindrical surface circumscribing a centerline or axis passing through the open area circumscribed by portions 16 and 17. In FIG. 1 this centerline generally corresponds to the longitudinal axis of shaft 20. Inner semicircular surface 18B and semicircular surface 19B together form an inner cylindrical surface circumscribing a centerline or axis passing through the open area circumscribed by portions 18 and 19. The bearing cap assemblies and inner cylindrical surfaces thereof in FIG. 1 are coaxial and have a common centerline or axis. Lower portions 16 and 18 are fixedly secured to base 42. A more specific example of the differential bearing caps assemblies generally represented in FIG. 1 is found in the General Engineering Bulletin H-170 describing the Rockwell-Standard H-170 Hypoid Rear Driving Axles, Automotive Divisions, North American Rockwell, Transmission and Axle Division, Detroit, MI. 48231, copyrighted by North American Rockwell Corporation in 1969. The inner cylindrical surface of one of the coaxial differential bearing carrier cap assemblies receives a circular ring or "cup", Part No. 33472, which receives differential cone bearing ring, Part No. 33275. The inner cylindrical surface of the other of the coaxial differential bearing carrier cap assemblies receives a circular ring or "cup", Part No. 47420, which receives differential cone bearing ring, Part No. 47490. The Rockwell-Standard General Engineering Bulletin H-170 is incorporated herein by reference.

Rod 20 carries two sets of spaced apart expandible and contractible honing tools. One set includes tools 11 and 12. First control means, not visible, are provided for expanding tool 11 in the direction of arrow C; for contracting tool 11 in the direction of arrow D; for expanding tool 12 in the direction of arrow A; and for contracting tool 12 in the direction of arrow B. The first control means simultaneously moves tool 11 in the direction of arrow C and tool 12 in the direction of arrow A and, simultaneously moves tool 11 in the direction of arrow D and tool 12 in the direction of arrow B. Tools 11 and 12 can comprise guides or can comprise abrading or honing stones. Guides contact and move over a cylindrical surface generally without abrading the surface. The other set of honing tools includes tools 13 and 14. Second control means, not visible, are provided for expanding tool 13 in the direction of arrow E; for contracting tool 13 in the direction of arrow F; for expanding tool 14 in the direction of arrow G; and, for contracting tool 14 in the direction of arrow H. The second control means simultaneously moves tool 13 in the direction of arrow E and tool 14 in the direction of arrow F and tool 14 in the direction of arrow H. Tools 13 and 14 can comprise guides or can comprise honing stones.

The second control means adjusts tools 13 and 14 independently of tools 11 and 12. The first control means adjusts tools 11 and 12 independently of tools 13 and 14. A handle 45 can be attached to end 21 of rod 20 to manually rotate rod 20 in the direction of arrow I, or a motor 44 can be attached to end 21 to rotate rod 20 in the direction of arrow I.

While in FIG. 1 rod 20 is illustrated as being unitary, rod 20 can, in the manner illustrated in FIG. 5, consist of two portions 20A and 20B, connected by sleeve 24. Sleeve 24 includes elongate cylindrical aperture 25 passing therethrough. Aperture 25 is sized to slidably receive end 23 of rod 20B and end 22 of rod 20A. Internally threaded apertures 26 pass through the wall of sleeve 24. Set screws 27 are turned into apertures 26 and against ends 22 and 23 to secure ends 22 and 23 in sleeve 24. Sleeve 24 of varying length can be provided so tool set 13, 14 and tool set 11, 12 can be positioned differing distances apart.

Figure 6:
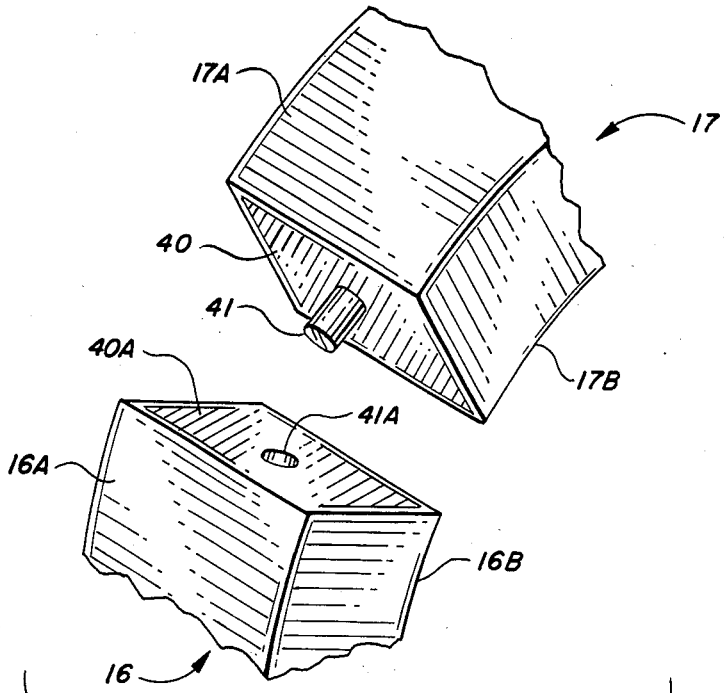
FIG. 6 is a perspective view further illustrating a differential bearing cap assembly.

As illustrated in FIGS. 1 and 6, lower portion 16 includes planar end surfaces 40A and upper portion 17 includes planar end surfaces 40. Each surface 40 normally contacts an opposing surface 40A, and a dowel or guide means 41 extending outwardly from surface 40 is slidably received in aperture 41A formed in surface 40A. Surfaces 40 and 40A lie in a plane which passes through the axis or centerline of the inner cylindrical surface comprised of semicircular surfaces 16B and 17B. Upper portion 19 has planar surfaces 60 similar to surfaces 40 of upper portion 17. Lower portion 18 has planar surfaces 60A similar to surfaces 40A of lower portion 16. The planar end surfaces 60, 60A lie in a plane passing through the centerline or axis of the inner cylindrical surface comprised of semicircular surfaces 18B and 19B. A dowel (not visible) is attached to and outwardly extends from each of the planar end surfaces of upper portion 19. An aperture (not visible) is formed in each of the planar end surfaces 60A of lower portion 18 and slidably receives the dowel extending from the opposing contacting planar end surface 60 of upper portion 19.

In FIG. 5, honing tool unit 50 includes shaft 20A, tools 13 and 14, and control means (not visible) for inwardly and outwardly adjusting tools 13 and 14 and for adjusting the pressure of tools 13 and 14 against a cylindrical surface. Honing tool unit 51 includes shaft 50B, tools 11 and 12, and control means (not visible) for inwardly and outwardly adjusting tools 11 and 12 and for adjusting the pressure of tools 11 and 12 against a cylindrical surface. In the presently preferred embodiment of the invention, tool unit 51 comprises a AN-815 heavy duty cylinder hone produced by Sunnen Products Company of 7910 Manchester, St. Louis, Mo. 63143 and described on p. 20 of the SUNNEN Automotive Accessories and Supplies Catalog A-7000; Weatherly Index 850 and 932. Tool unit 50 comprises a Sunnen AN-111 standard portable cylinder hone also described on p. 20 of the SUNNEN catalog A-7000. The Sunnen AN-815 and AN-111 hones include conventional manual controls for rotating the tools thereon inwardly and outwardly. As would be appreciated by those of skill in the art, means for automatically inwardly and outwardly displacing tools 13, 14 are known in the art.

It is presently preferred that a motor 44 be attached to end 21 of tool unit 51 to rotate shaft 20B, and consequently, shaft 20A and sleeve 24. The motor 44 includes handles which permit a user to grasp motor 44 during rotation of shafts 20A and 20B.

The abrading wheel of FIGS. 2 and 3 includes upper convex abrading surface 32. The convex curvature of surface 32 is greatly exaggerated for purposes of the drawings. The convex shape of surface 32 tends to produce more uniform grinding over a planar surface, for instance planar surface 40 in FIG. 4, pressed against surface 32. Spring biased member 31 extends upwardly through aperture 46 formed in the center of abrading surface 32. Surface 32 rotates in the direction of arrow M. The normal unloaded position of member 31 is shown in FIG. 2. When the dowel 41 of upper portion 17 is placed in aperture 31A formed in member 31, the weight of the upper portion 17 depresses member 31 to the position illustrated in FIGS. 3, and surface 40 bears against abrading surface 32. When portion 17 is removed from surface 32 and member 31, member 31 returns to the position of FIG. 2. Surface 32 is formed in a slightly convex manner such that the rate at which material is abraded from surface 40 tends to be generally uniform at all points on the surface 40. If grinding surface 32 were planar and flat, the rate at which surface 40 is abraded would be greater for portions of surface 40 farther away from dowel 41.

In use of the method and apparatus of the invention, the differential bearings and the cups which normally carry the bearings are removed form the differential cap assemblies to expose surfaces 16B, 17B, 18B, 19B as shown in FIG. 1. If necessary, prior to removal of the differential bearings and cups, other components of the rear drive axle are also disassembled or removed. The bolts (not shown) securing upper portions 17 and 19 to lower portions 16 and 18, respectively, are removed and upper portions 17 and 19 are lifted off of lower portions 16 and 18. Planar end surfaces 40, 60 of upper portions 17, 19 are abraded in the manner indicated in FIG. 4. Dowel 41 is placed in aperture 31A and the weight of member 17 depresses spring biased member 31 to permit surface 40 to contact rotating convex surface 32. Surface 40 is maintained against surface 32 until a sufficient amount of material, typically 0.001 to 0.010 inches, is ground off. Each surface 40, 60 is abraded on surface 32 in a similar manner. After surfaces 40, 60 are abraded upper portions 17 and 19 are bolted onto lower portions 16 and 18, respectively. Shaft 20 is then positioned inside the inner cylindrical differential cup receiving surfaces in the manner shown in FIG. 1. Tools 13 and 14 are outwardly adjusted in the directions of arrows E and G until tool 13 contacts surface 17B and tool 14 contacts surface 16B. Tools 12 and 11 are outwardly adjusted in the directions of arrows A and C until tool 12 contacts inner surface 19B and tool 11 contacts inner surface 18B. If surfaces 16B and 17B are not to be abraded, tools 13 and 14 are guides; otherwise, tools 13 and 14 are honing stones. Similarly, if surfaces 18B and 19B are not to be abraded, tools 11 and 12 are guides; otherwise, tools 11 and 12 are honing stones. Handle 45 or motor 44 is used to rotate rod 20 and tools 11–14. Handle 45 or motor 44 is, when grasped, also utilized to reciprocate shaft 20 in the directions indicated by arrows J. After rod 20 has been rotated for a selected period of time, the rotation of rod 20 is halted and surfaces 16B and 19B are examined to determine if a sufficient amount of abrading or polishing has occurred. If necessary, tools 11–14 are adjusted outwardly from rod 20 an additional distance, and rod 20 is again rotated to further polish surfaces 18B and 19B and/or surfaces 16B and 17B. The ability to adjust tool set 13, 14 independently of tool set 11, 12 and vice-versa, enables the honing apparatus of the invention to be easily utilized to polish a pair of coaxial cylindrical surfaces each having a different diameter.

When upper portion 17 is removed from lower portion 16, ends 40 of portion 17 can be slightly inwardly bent toward one another prior to abrading surfaces 40 on surface 32. Similarly, when upper portion 19 is removed from lower portion 18, the ends of portion 19 can be slightly inwardly bent toward one another prior to abrading surfaces 60 on surface 32.

If surfaces 18B and 19B are being honed with the honing apparatus of FIG. 1, and surfaces 16B and 17B are not being honed, then tools 13 and 14 can comprise guides which bear against and travel over surfaces 16B and 17B but do not abrade surfaces 16B and 17B. Further, the end of shaft 20 passing through the differential bearing cap assembly including surfaces 16B and 17B can be rotatably mounted in a plate or other structural member and merely serve as a guide to keep rod 20 in the orientation shown in FIG. 1. When the end of rod 20 is rotatably mounted in a plate in this fashion, tools 13 and 14 do not have to be used when tools 11 and 12 are used to abrade surfaces 18B and 19B.

Having described my invention in such terms as to enable those skilled in the art to understand and practice it, and having identified the presently preferred embodiments thereof, I claim:

1. A method for truing the coaxial cylindrical inner surfaces of the spaced apart differential bearing cap assemblies mounted on a base in a truck axle drive unit, said cylindrical surfaces normally carrying a cup which receives a differential bearing, said differential bearing cap assemblies each including a lower generally semicircular portion attached to said base and including a portion of one of said coaxial cylindrical inner surfaces, said lower portion having a pair of planar surfaces each with an aperture formed therein, and an upper generally semicircular portion including a portion of said one of said coaxial cylindrical inner surfaces and having a pair of planar surfaces opposed to and normally contacting said planar surfaces of said lower portion, and a pair of guide means each outwardly extending from one of said planar surfaces of said upper member and received by one of said apertures in said planar surfaces of said lower portion, said method comprising the steps of (a) removing said cup and differential bearing from said coaxial inner surface of each of said differential bearing cap assemblies;

(b) removing said upper generally semicircular portion from at least one of said differential bearing cap assemblies;

(c) abrading and truing each planar surface of at least one of said upper portions on grinding apparatus, said grinding apparatus including (i) a generally convex rotating abrading surface with an opening formed through the center thereof; and, (ii) a depressible member extending through said opening and having an aperture sized to slidably receive said guide means, each of said planar surfaces being abraded and trued by placing said guide means in said aperture and pressing said planar surface against said rotating convex surface;

(d) attaching said upper generally semicircular portions to one of said lower portions;

(e) honing at least one of said coaxial cylindrical inner surfaces with abrading apparatus, said abrading apparatus including (i) a rotating shaft, (ii) at least a pair of expansible and contractible honing tools spaced apart and carried on said shaft, at least one of said tools comprising an abrasive stone, (iii) means for rotating said shaft, (iv) means for reciprocating said shaft to repeatedly traverse said honing tools over said coaxial cylindrical inner surfaces, and (v) means for independently expandibly and contractibly adjusting each one of said honing tools independently of the other of said honing tools, said honing of said cylindrical inner surface including the steps of (vi) placing said shaft and honing tools inside said cylindrical inner surfaces, (vii) operating said adjustment means to expand each of said honing tools against one of said cylindrical inner surfaces, and (viii) operating said reciprocating means and rotating means to rotatably reciprocate said honing tools over said cylindrical inner surfaces.

* * * * *